US011317695B2

(12) United States Patent
Hwang

(10) Patent No.: US 11,317,695 B2
(45) Date of Patent: May 3, 2022

(54) COSMETIC DROPPER

(71) Applicant: F.S.KOREA INDUSTRIES INC., Seoul (KR)

(72) Inventor: Jae Kwang Hwang, Seoul (KR)

(73) Assignee: F.S. Korea Industries Inc., Seoul (KR)

( * ) Notice: Subject to any disclaimer, the term of this patent is extended or adjusted under 35 U.S.C. 154(b) by 0 days.

(21) Appl. No.: 17/314,645

(22) Filed: May 7, 2021

(65) Prior Publication Data

US 2021/0368963 A1 Dec. 2, 2021

(30) Foreign Application Priority Data

May 26, 2020 (KR) ..... 20-2020-0001767

(51) Int. Cl.
*B65D 47/18* (2006.01)
*A45D 34/04* (2006.01)
*B65D 51/32* (2006.01)

(52) U.S. Cl.
CPC ..... *A45D 34/04* (2013.01); *B65D 47/18* (2013.01); *B65D 51/32* (2013.01)

(58) Field of Classification Search
CPC ..... B65D 47/18; B65D 51/32; B01L 3/0282; A45D 34/04; A45D 2200/055; A45D 40/26; G01F 11/027; G01F 11/028
See application file for complete search history.

(56) References Cited

U.S. PATENT DOCUMENTS 2,129,144 A * 9/1938 Lancaster ..... G01F 11/025 222/542
5,746,349 A * 5/1998 Putteman ..... A61J 1/2096 141/22
5,836,359 A * 11/1998 Seidler ..... A61M 11/007 141/94
6,045,003 A * 4/2000 Seidler ..... B01L 3/0224 141/94
6,112,779 A * 9/2000 Camilla ..... G01F 11/027 222/49
6,250,504 B1 * 6/2001 Maffei ..... A61J 1/2096 141/381
6,609,635 B1 * 8/2003 Maffei ..... G01F 11/027 222/50
9,427,064 B2 * 8/2016 Kim ..... A45D 34/04

* cited by examiner

*Primary Examiner* — Frederick C Nicolas
*Assistant Examiner* — Randall A Gruby
(74) *Attorney, Agent, or Firm* — Rabin & Berdo, P.C.

(57) ABSTRACT

Disclosed is a cosmetic dropper which includes a container main body having a container body in which a cosmetic liquid is stored and a cap part detachably coupled to the container body; a pipette coupling part coupled to the cap part; a pipette part having a pipette member coupled to the pipette coupling part, a piston coupling bar provided to elevate inside the pipette member, and a piston part coupled to an end of the piston coupling part to elevate together with the piston coupling bar and allows the cosmetic liquid to be suctioned into the pipette member or discharged to the outside reversely; and a separation prevention part coupled to the piston coupling bar so as to cover an outer wall of the piston coupling bar to prevent the end of the piston coupling bar from being separated to the outside of the pipette member.

5 Claims, 7 Drawing Sheets

COSMETIC DROPPER

CROSS-REFERENCE TO RELATED APPLICATIONS

This application claims the priority of Korean Utility Model Application No. 20-2020-0001767 filed on May 26, 2020, in the Korean Intellectual Property Office, the disclosure of which is incorporated herein by reference.

BACKGROUND OF THE INVENTION

Field of the Invention

The present invention relates to a cosmetic dropper and more particularly, to a cosmetic dropper capable of sucking out and using a cosmetic liquid by a piston method and preventing a portion of sucking out the cosmetic liquid from being separated.

Description of the Related Art

In general, as a method of using liquid cosmetic contents such as cosmetics, which preferably use a small amount of eye cream and the like at a time, but use a precise quantity, in the related art, a method of individually packaging the contents in the form of a capsule or the like by an amount to be used for each use time was used.

However, such an individual packaging method has a problem in that it is inefficient because a relatively large amount thereof remains in the capsule even after a user uses the cosmetic contents.

In order to overcome the problems of such an individual packaging method, after the contents are received in a container, there is disclosed a configuration of extracting the cosmetic contents every use by using an extracting means having a general pipette or syringe structure or using an extracting means having a configuration of a push pump.

Meanwhile, when the cosmetic contents are extracted by using the extracting means of a conventional syringe structure, it is inconvenient because an area coupled with the piston is exposed to the outside of the container and it is unsanitary because foreign substances may be stained on the exposed area, so that the improvement thereof is required.

The above-described technical configuration is a background technique for assisting the understanding of the present invention, and does not mean a conventional technology widely known in the art to which the present invention belongs.

SUMMARY OF THE INVENTION

Therefore, the present invention has been made in efforts to provide a cosmetic dropper capable of sucking out and using a cosmetic liquid by a piston method and preventing a portion of sucking out the cosmetic liquid from being separated.

According to an aspect of the present invention, there is provided a cosmetic dropper including: a container main body having a container body in which a cosmetic liquid is stored and a cap part detachably coupled to the container body; a pipette coupling part coupled to the cap part; a pipette part having a pipette member coupled to the pipette coupling part, a piston coupling bar provided to elevate inside the pipette member, and a piston part which is coupled to an end of the piston coupling bar to elevate together with the piston coupling bar and allows the cosmetic liquid stored in the container body to be suctioned into the pipette member or discharged to the outside reversely; and a separation prevention part coupled to the piston coupling bar so as to cover an outer wall of the piston coupling bar to prevent the end of the piston coupling bar from being separated to the outside of the pipette member.

The separation prevention part may include a pair of separation prevention bodies which is provided to cover the outer wall of the piston coupling bar and detachably coupled to each other.

An engaging step may be provided on the outer wall of the piston coupling bar, and an outer diameter of the engaging step may be provided to be larger than an inner diameter by coupling of the pair of separation prevention bodies so that the engaging step may be engaged to the pair of separation prevention bodies to prevent the separation of the piston coupling bar.

One end of the pair of separation prevention bodies may be supported to one end of the pipette member.

The cosmetic dropper may further include an extension part which protrudes from the end of the pair of separation prevention bodies to the cap part to block a space between the cap part and the pair of separation prevention bodies.

The pipette coupling part may include a pipette coupling body to which the pipette member is coupled; a coupling part flange which is provided in the pipette coupling body to support an inner cap of the cap part; and a coupling part post which is provided in the pipette coupling body so as to be separated from the coupling part flange to be coupled between the outer cap of the cap part and the pair of separation prevention bodies of the separation prevention part.

According to the embodiments of the present invention, it is possible to be conveniently used by preventing an area provided with the piston part from being separated to the outside of the pipette member by the separation prevention part which is coupled to the piston coupling bar to cover the outer wall of the piston coupling bar to prevent the end of the piston coupling bar from being separated to the outside of the pipette member, and to be sanitarily used by preventing foreign substances from being stained on the area provided with the piston part.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
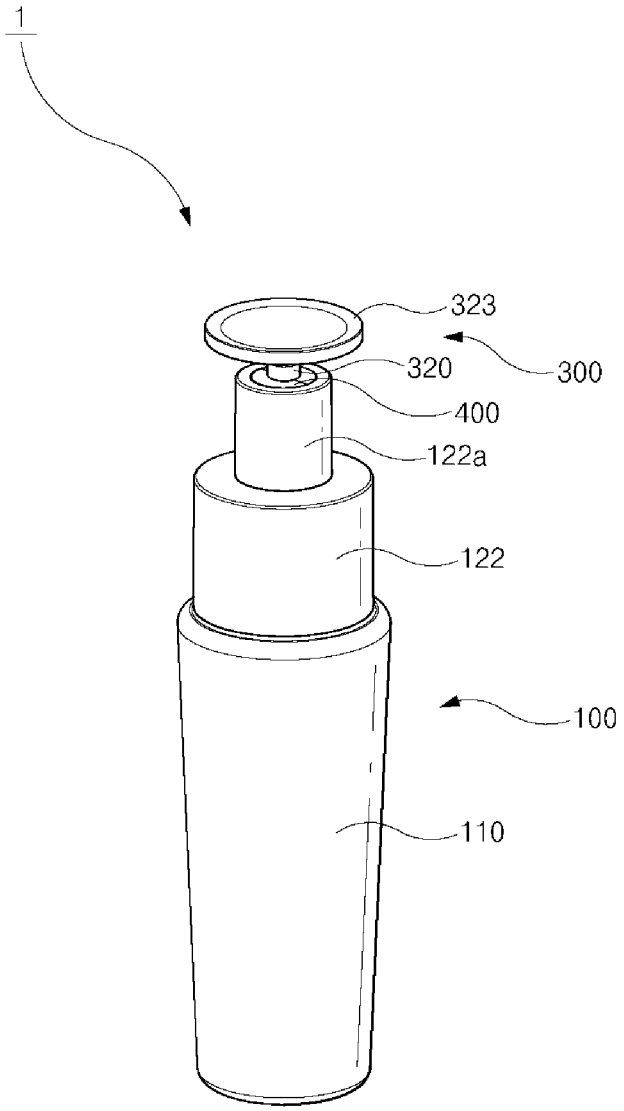
FIG. 1 is a perspective view schematically illustrating a cosmetic dropper according to an embodiment of the present invention.

In order to sufficiently appreciate the present invention, operational advantages of the present invention, and objects achieved by embodiments the present invention, accompanying drawings illustrating preferred embodiments of the present invention and contents illustrated in the accompanying drawings should be referred.

Hereinafter, preferred embodiments of the present invention will be described in detail with reference to the accompanying drawings. Like reference numerals illustrated in the respective drawings designate like members.

Figure 2:
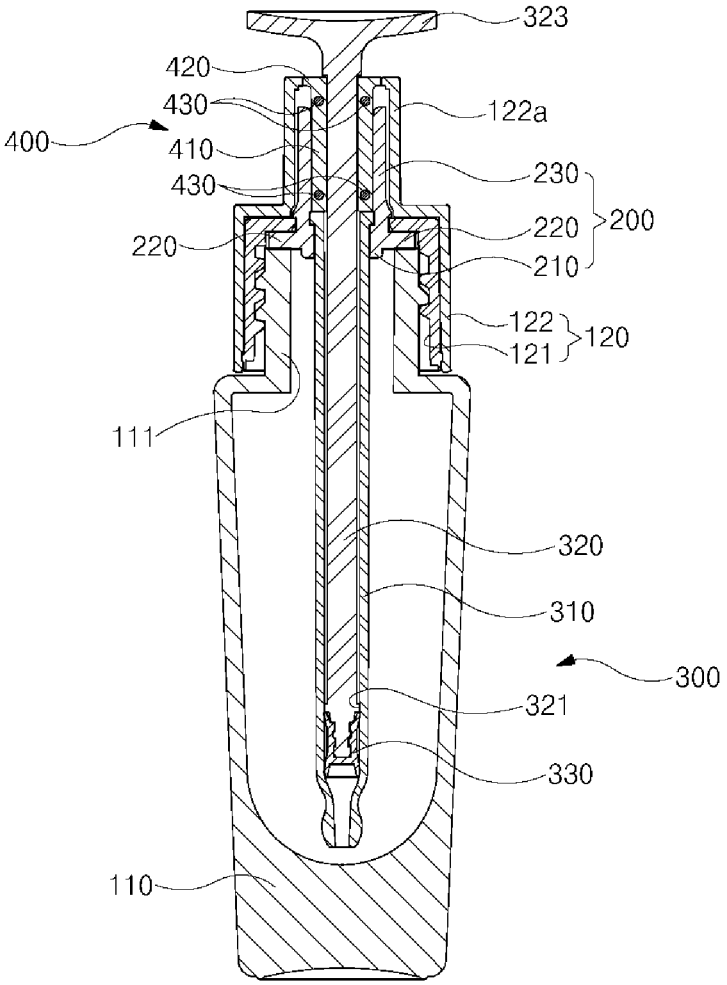
FIG. 2 is a cross-sectional view of FIG. 1.
Figure 3:
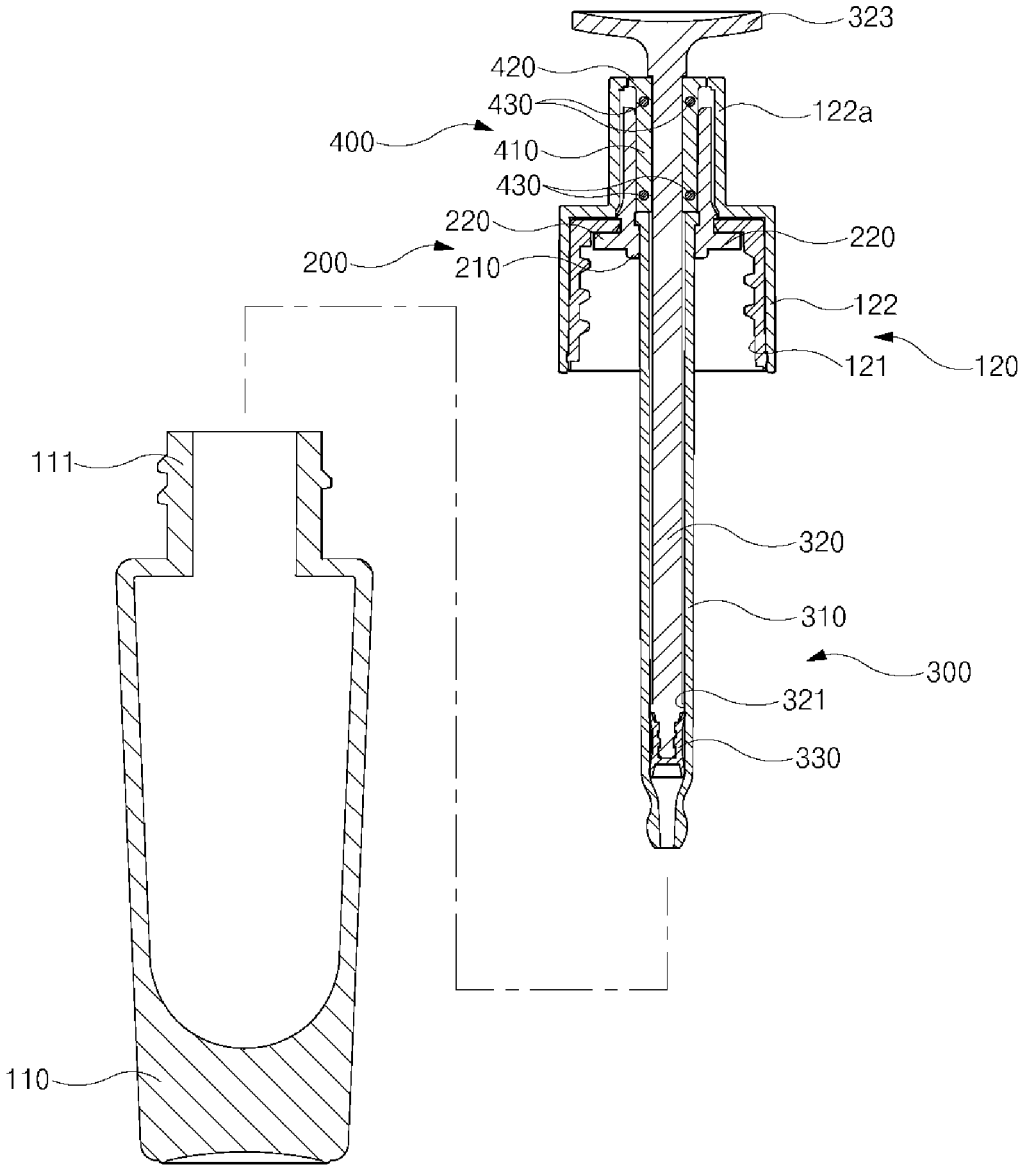
FIG. 3 is an exploded cross-sectional view of FIG. 2.
Figure 4:
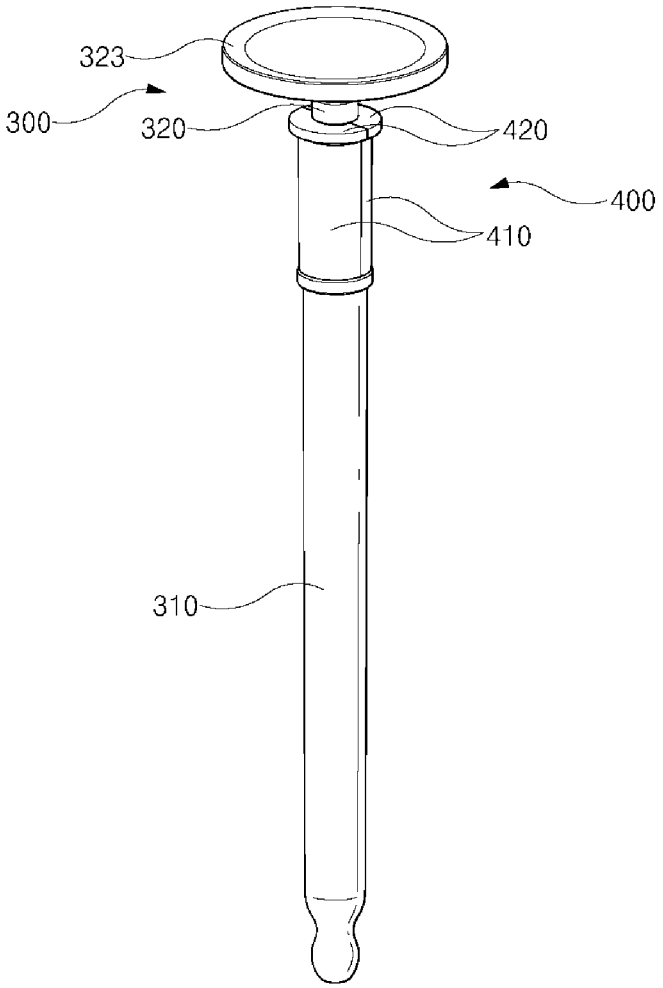
FIG. 4 is a schematic perspective view of a pipette part and a separation prevention part illustrated in FIG. 3.
Figure 5:
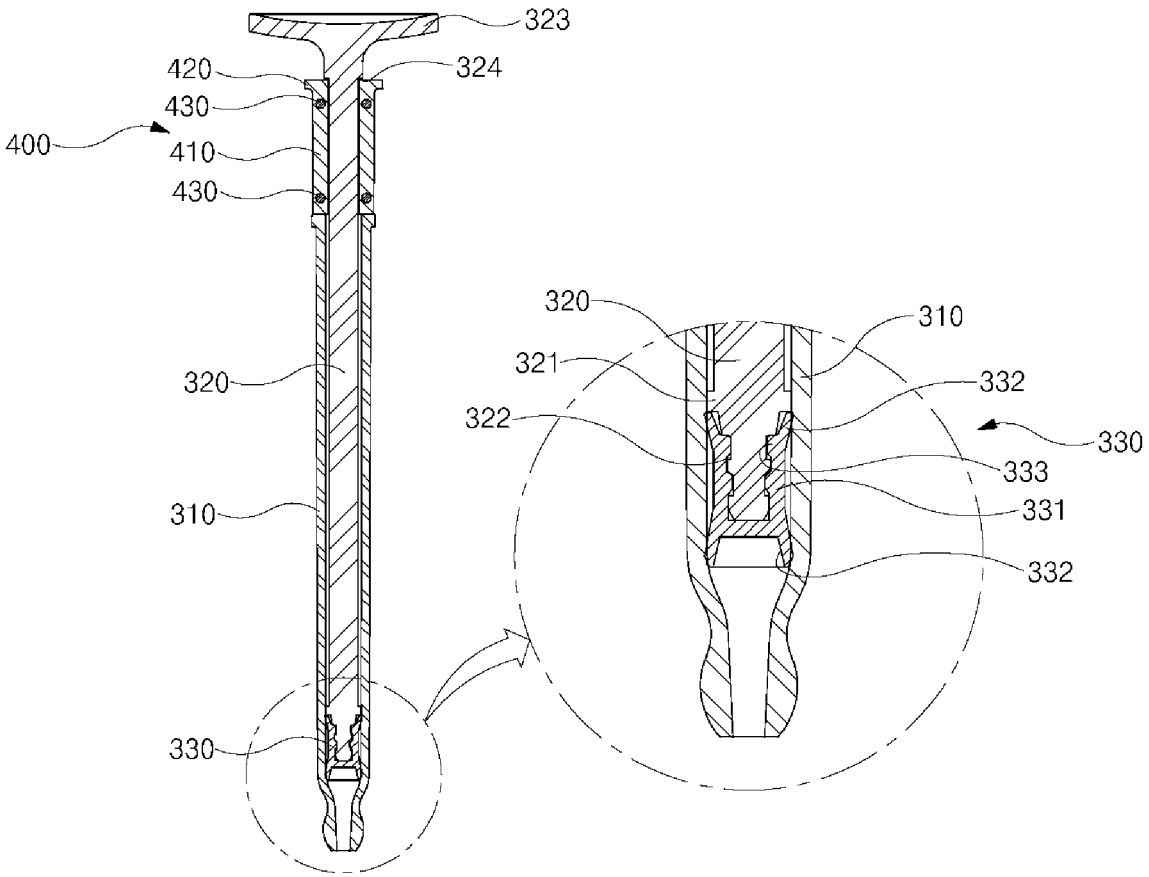
FIG. 5 is a cross-sectional view of FIG. 4.
Figure 6:
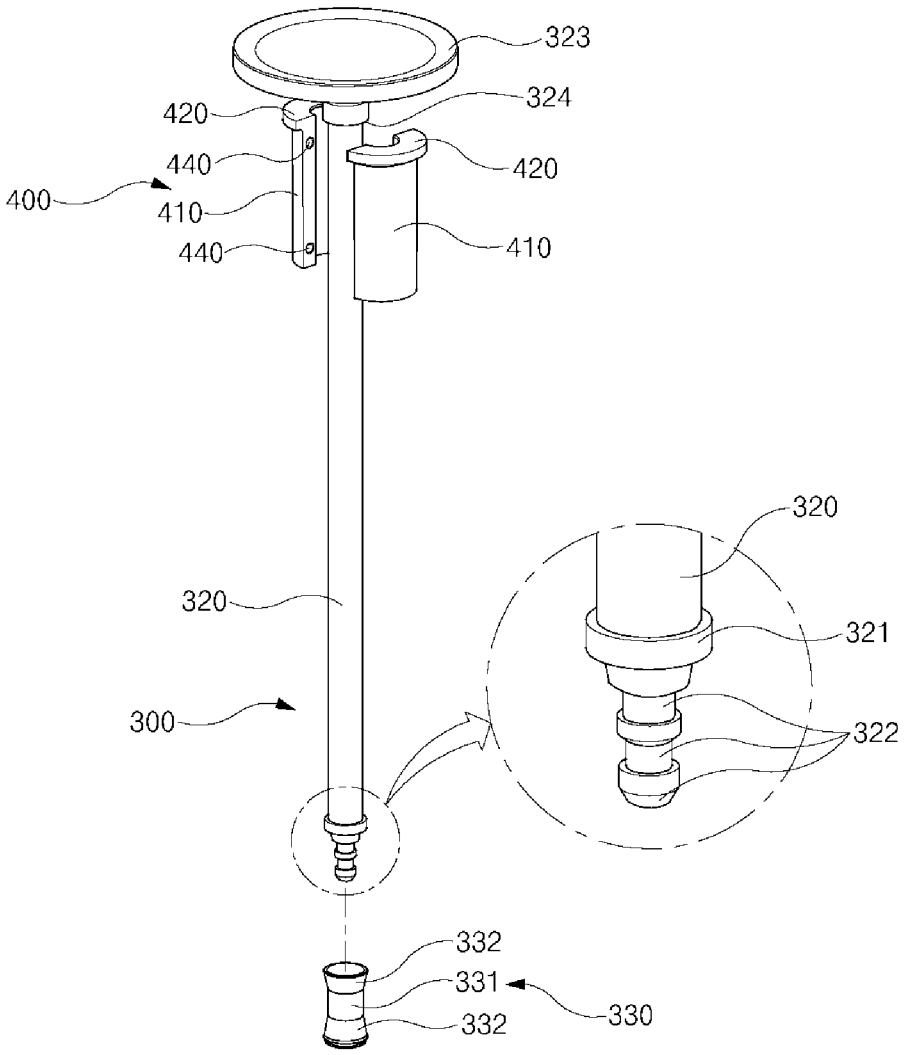
FIG. 6 is a diagram illustrating that a pair of separation prevention bodies illustrated in FIG. 4 is separated from each other and a piston part is separated from a piston coupling bar.
Figure 7:
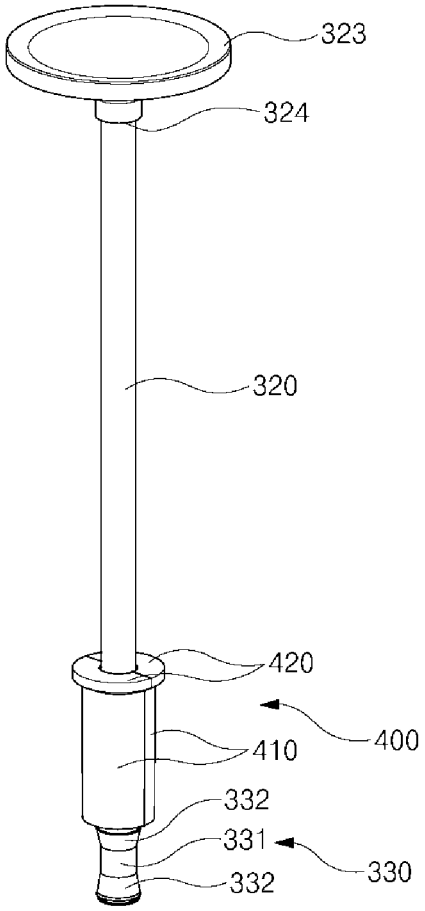
FIG. 7 is a diagram schematically illustrating that an area of the piston part is engaged to the separation prevention part illustrated in FIG. 6.

FIG. 1 is a perspective view schematically illustrating a cosmetic dropper according to an embodiment of the present invention, FIG. 2 is a cross-sectional view of FIG. 1, FIG. 3 is an exploded cross-sectional view of FIG. 2, FIG. 4 is a schematic perspective view of a pipette part and a separation prevention part illustrated in FIG. 3, FIG. 5 is a cross-sectional view of FIG. 4, FIG. 6 is a diagram illustrating that a pair of separation prevention bodies illustrated in FIG. 4 is separated from each other and a piston part is separated from a piston coupling bar, and FIG. 7 is a diagram schematically illustrating that an area of the piston part is engaged to the separation prevention part illustrated in FIG. 6.

As illustrated in these drawings, a cosmetic dropper 1 according to the embodiment includes a container main body 100 having a container body 110 in which a cosmetic liquid is stored and a cap part 120 detachably coupled to the container body 110, a pipette coupling part 200 coupled to the cap part 120, a pipette part 300 coupled to the pipette coupling part 200 to suction or discharge the cosmetic liquid, and a separation prevention part 400 coupled to a part of the pipette part 300 to prevent the part thereof from being separated.

As illustrated in FIG. 3, the container main body 100 includes the container body 110 and the cap part 120 coupled to an upper portion of the container body 110.

As illustrated in FIG. 3, in the container body 110 of the container main body 100, a head 111 is provided, and on an outer wall of the head 111, threads are provided to be detachably coupled to an inner cap 121 of the cap part 120.

As illustrated in FIG. 2, the cap part 120 of the container main body 100 includes an outer cap 122 which is coupled to an outer wall of the inner cap 121 of which an inner wall is screw-coupled to the head 111 of the container body 110 to support the separation prevention part 400.

In the embodiment, as illustrated in FIG. 2, a pipette coupling body 220 of the pipette coupling part 200 may be fitted to the inner cap 121.

Further, in the embodiment, the outer cap 122 may be detachably engaged to the outer wall of the inner cap 121.

Furthermore, in the embodiment, an extension post 122*a* is provided on the upper portion of the outer cap 122, and an upper end of the extension post 122*a* is in contact with an extension part 420 of the separation prevention part 400 to support the separation prevention part 400 and seal a space between the extension post 122*a* and the extension part 420.

In addition, in the embodiment, when the cap part 120 is separated from the container body 110, as illustrated in FIG. 3, the pipette coupling part 200, the pipette part 300, and the separation prevention part 400 may be separated together with the cap part 120.

As illustrated in FIGS. 2 and 3, the pipette coupling part 200 is coupled to the inner cap 121 and the outer cap 122 to be provided as a coupling place of the pipette part 300 and press the separation prevention body 410 of the separation prevention part 400.

In the embodiment, as illustrated in FIG. 3, the pipette coupling part 200 includes a pipette coupling body 220 of which an outer wall is fitted to the inner cap 121 and to which a pipette member 310 is engaged, a coupling part flange 220 which is provided below the pipette coupling body 220 to support a ceiling portion of the inner cap 121, and a coupling part post 230 which is extended on the upper portion of the pipette coupling body 220 and is inserted and coupled to a space between the outer cap 122 and the separation prevention body 410.

In the embodiment, in the pipette coupling body 220 in an area where the outer cap 122 is in contact with the pipette coupling body 220, as illustrated in FIG. 3, a protrusion is provided and inserted and coupled to a groove provided in the outer cap 122 to stably support the pipette coupling body 220.

As illustrated in FIG. 3, the pipette part 300 is coupled to the pipette coupling part 200 and serves to suction the cosmetic liquid in the container body 110 to drop a predetermined amount of cosmetic liquid on an area used by the user, for example, a hand, a face, or the like.

In the embodiment, as illustrated in FIG. 3, the pipette part 300 includes a pipette member 310 which has an upper end coupled to the pipette coupling body 220 and is provided with a space portion opened so that the cosmetic liquid is suctioned therein or discharged to the outside, a piston coupling bar 320 of which one end is provided to elevate (ascend or descend) inside the pipette member 310 and the other end is provided to be exposed to the outside of the outer cap 122, and a piston part 330 which is coupled to one end of the piston coupling bar 320 to elevate together with the piston coupling bar 320 and allows the cosmetic liquid in the container body 110 to be suctioned into the pipette member 310 or discharged to the outside thereof.

As illustrated in FIG. 3, the pipette member 310 of the pipette part 300 may be provided so that an upper end thereof is engaged to the pipette coupling body 220, and a lower end thereof is opened. In the embodiment, the cosmetic liquid may be suctioned into the pipette member 310 or discharged to the outside thereof by the elevation of the piston part 330.

The piston coupling bar 320 of the pipette part 300 elevates the piston part 330, and as illustrated in FIG. 5, an engaging step 320 is provided on a lower portion thereof. In the embodiment, since an outer diameter of the engaging step 321 is provided to be larger than an inner diameter by coupling of the pair of separation prevention bodies 410, the engaging step 320 is engaged to the pair of separation prevention bodies 410 at the time of ascending of the piston coupling bar 320 to prevent the separation of the piston coupling bar.

In the embodiment, as illustrated in FIG. 6, a plurality of coupling bar grooves 322 is provided on a lower portion of the piston coupling bar 320, that is, a lower portion of the engaging step 321. In the embodiment, as illustrated in FIG. 5, a plurality of piston protrusions 333 of the piston part 330 is inserted and coupled to the plurality of coupling bar grooves 322 to prevent the piston part 330 from being separated at the time of the elevation of the piston coupling bar 320. This example is illustrated in FIG. 7.

Further, in the embodiment, on the upper end of the piston coupling bar 320, a handle 323 having a diameter larger than that of the piston coupling bar 320 may be provided.

Furthermore, in the embodiment, as illustrated in FIG. 5, on the upper portion of the piston coupling bar 320, a stopper jaw 320 is provided, and the upper end of the separation prevention body 410 may be engaged and supported to the stopper jaw 324.

As illustrated in FIG. 5, the piston part 330 of the pipette part 300 is coupled to the lower end of the piston coupling bar 320 and elevated together at the time of the elevation of the piston coupling bar 320 so as to allow the cosmetic liquid in the container body 110 to be suctioned into the pipette member 310 or discharged to the outside of the pipette member 310 reversely.

In the embodiment, as illustrated in FIG. 5, the piston part 330 includes a piston body 331 into which an end of the piston coupling bar 320 is inserted and coupled, an extension part 332 provided on the upper and lower portions of the piston body 331 to be larger than the diameter of the piston body 331, and a plurality of piston protrusions 333 provided on the inner wall of the piston body 331 to be inserted and coupled to the plurality of coupling bar grooves 322.

As illustrated in FIGS. 2 and 3, the separation prevention part 400 is coupled to the piston coupling bar 320 so as to cover the outer wall of the piston coupling bar 320 to prevent the end of the piston coupling bar 320 from being separated from the outside of the pipette member 310.

In the embodiment, as illustrated in FIG. 4, the separation prevention part 400 includes a pair of separation prevention bodies 410 provided to cover the outer wall of the piston coupling bar 320 and detachably coupled to each other, an extension part 420 which protrudes from the upper end of the pair of separation prevention bodies 410 to the cap part 120 to block a space between the cap part 120 and the pair of separation prevention bodies 410, a coupling groove 430 provided on one of the pair of separation prevention bodies 410, and a coupling protrusion 440 provided on the other separation prevention body 410 to be coupled to the coupling groove 430.

In the embodiment, the outer diameter of the engaging step 321 provided at the piston coupling bar 320 is provided to be larger than the inner diameter thereof by the coupling of the pair of separation prevention bodies 410 so that the engaging step 320 is engaged to the pair of separation prevention bodies 410 to prevent the separation of the piston coupling bar 320.

Further, in the embodiment, as illustrated in FIG. 5, the end of the pair of separation prevention bodies 410 may be supported to a top sectional portion of the pipette member 310.

As described above, according to the embodiment, it is possible to be conveniently used by preventing an area provided with the piston part from being separated to the outside of the pipette member by the separation prevention part which is coupled to the piston coupling bar to cover the outer wall of the piston coupling bar to prevent the end of the piston coupling bar from being separated to the outside of the pipette member, and to be sanitarily used by preventing foreign substances from being stained on the area provided with the piston part.

As described above, the present invention is not limited to the embodiments described herein, and it would be apparent to those skilled in the art that various changes and modifications may be made without departing from the spirit and the scope of the present invention. Therefore, these changes or modifications should be included in the appended claims of the present invention.

What is claimed is:

1. A cosmetic dropper comprising:

a container main body having a container body in which a cosmetic liquid is stored and a cap part detachably coupled to the container body;

a pipette coupling part coupled to the cap part;

a pipette part having a pipette member coupled to the pipette coupling part, a piston coupling bar provided to elevate inside the pipette member, and a piston part which is coupled to an end of the piston coupling bar to elevate together with the piston coupling bar and allows the cosmetic liquid stored in the container body to be suctioned into the pipette member or discharged to the outside reversely; and a separation prevention part coupled to the piston coupling bar so as to cover an outer wall of the piston coupling bar to prevent the end of the piston coupling bar from being separated to the outside of the pipette member;

wherein the separation prevention part includes a pair of separation prevention bodies which is provided to cover the outer wall of the piston coupling bar and detachably coupled to each other.

2. The cosmetic dropper of claim 1, wherein an engaging step is provided on the outer wall of the piston coupling bar, and an outer diameter of the engaging step is provided to be larger than an inner diameter by coupling of the pair of separation prevention bodies so that the engaging step is engaged to the pair of separation prevention bodies to prevent the separation of the piston coupling bar.

3. The cosmetic dropper of claim 1, wherein one end of the pair of separation prevention bodies is supported to one end of the pipette member.

4. The cosmetic dropper of claim 1, further comprising:

an extension part which protrudes from the end of the pair of separation prevention bodies to the cap part to block a space between the cap part and the pair of separation prevention bodies.

5. The cosmetic dropper of claim 1, wherein the pipette coupling part comprises:

a pipette coupling body to which the pipette member is coupled;

a coupling part flange which is provided in the pipette coupling body to support an inner cap of the cap part; and a coupling part post which is provided in the pipette coupling body so as to be separated from the coupling part flange to be coupled between an outer cap of the cap part and the pair of separation prevention bodies of the separation prevention part.

* * * * *